United States Patent [19]

Tierney et al.

[11] Patent Number: 4,742,927

[45] Date of Patent: May 10, 1988

[54] TAMPER PROOF SEAL FOR A CONTAINER CLOSURE

[75] Inventors: Richard J. Tierney, Caringbah, Australia; Robert C. Brown, Auckland, New Zealand

[73] Assignee: PDL Packaging Limited, New Zealand

[21] Appl. No.: 940,552

[22] Filed: Dec. 12, 1986

[30] Foreign Application Priority Data

Dec. 13, 1985 [AU] Australia ..... PH3865

[51] Int. Cl.[4] ..... B65D 41/34

[52] U.S. Cl. ..... 215/216; 215/253; 215/274; 215/330

[58] Field of Search ..... 215/216, 253, 330, 274

[56] References Cited

U.S. PATENT DOCUMENTS 4,570,810 2/1986 Hawkins ..... 215/253

*Primary Examiner*—Donald F. Norton

*Attorney, Agent, or Firm*—Scully, Scott, Murphy & Presser

[57] ABSTRACT

A tamper proof seal and container closure device including, in combination a seal ring and a closure, said seal ring being provided on its inner face with at least one recess and at least one stop, said closure being provided with at least one projection on the lower edge of the closure, said projection being adapted to fit within the recess of the seal so that when the combination seal ring and closure are fitted to a bottle neck the stop on the seal ring locks the seal ring, closure and bottle neck together. The combined seal ring and closure can be locked onto the bottle neck by the interaction between the stop on the seal and a complementary stop formed on the side of the base of the bottle neck.

12 Claims, 6 Drawing Sheets

TAMPER PROOF SEAL FOR A CONTAINER CLOSURE

FIELD OF THE INVENTION

The present invention relates to tamper proof seals for closure devices, and in particular to a tamper proof seal for tamper proof closure devices used on containers housing dangerous substances in which the seal must be broken with the aid of a tool in order to open the container.

DESCRIPTION OF THE PRIOR ART

Prior art child proof seals for closures exist but only prevent a child, with little strength and little know-how, from opening a container. Such seals are sufficient when the only risk is that a child would unknowingly attempt to open a container housing a dangerous substance. Other circumstances exist when an adolescent or even an adult, would purposely try to open the container, in say a shop, with the intent to do harm or to misappropriate the contents. A seal for a closure device is therefore needed, which will be able to be broken readily but only with the correct tools and in such a manner so as to attract attention to the broken seal when the container has been opened.

It is an object of the present invention to overcome or substantiallv ameliorate the abovementioned disadvantages.

SUMMARY OF THE INVENTION

In accordance with one aspect of the present invention there is provided a tamper proof seal and container closure device including, in combination;

a seal ring and a closure, said seal ring being provided on its inner face with at least one recess and at least one stop, said closure being provided with at least one projection on the lower edge of the closure, said projection being adapted to fit within the recess of the seal so that when the combination seal ring and closure are fitted to a bottle neck the stop on the seal ring locks the seal ring, closure and bottle neck together.

The combined seal ring and closure can be locked onto the bottle neck by the interaction between the stop on the seal and a complementary stop formed on the side of the base of the bottle neck.

Each projection can have a stepped region which extends out from the outside wall of the closure to form a latch which co-operates with a step on the edge of the recess to locate the closure and seal ring together.

The seal ring can be formed as an annular skirt with either a base ring, middle ring and top ring or only a base ring and top ring.

The annular skirt with base ring, middle ring and top ring can have its base ring with an internal diameter designed to fit over the base of the bottle neck, its middle ring with an internal diameter similar to the internal diameter of the closure and its top ring has an internal diameter designed to engage with the base of the closure.

The annular skirt with only a base ring and top ring has the base ring with an internal diameter designed to fit over the base of the neck and the top ring has an internal diameter designed to engage with the base of the closure.

The seal ring can have the side wall thereof reduced in thickness and height at one point to produce a more easily cut region for assisting in removal of the seal ring.

Preferably the combination is such that to release the closure the seal must be cut to allow the closure to pass over the stop at the base of the neck and rotate relative to the neck to thereby release the closure.

Embodiments of the present invention will now be described in detail, by way of example only, with reference to the accompanying drawings.

DESCRIPTIONS OF THE PREFERRED EMBODIMENTS

Figure 1:
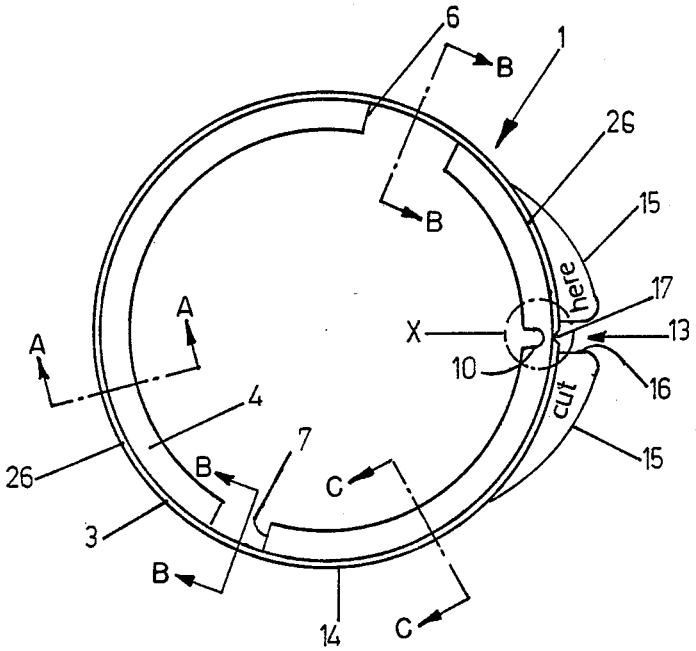
FIG. 1 is a top plan view of the seal of the present invention.
Figure 4:
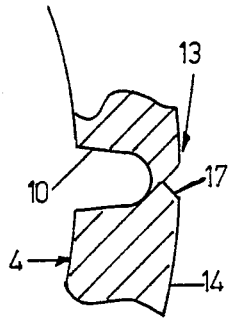
FIG. 4 is a plan view on an enlarged scale of the region X referred to in FIG. 1.
Figure 2:
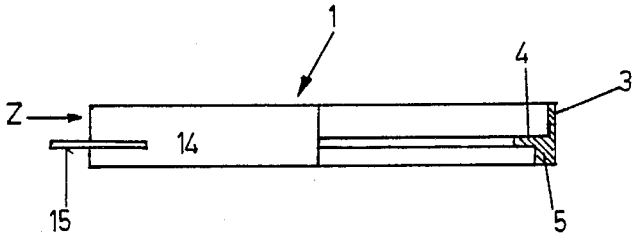
FIG. 2 is a side view partly sectioned of the seal of FIG. 1.
Figure 5:
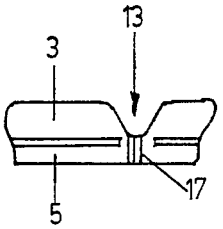
FIG. 5 is a view in the direction of arrow Z shown in FIG. 2 of part of the seal ring.
Figure 8:
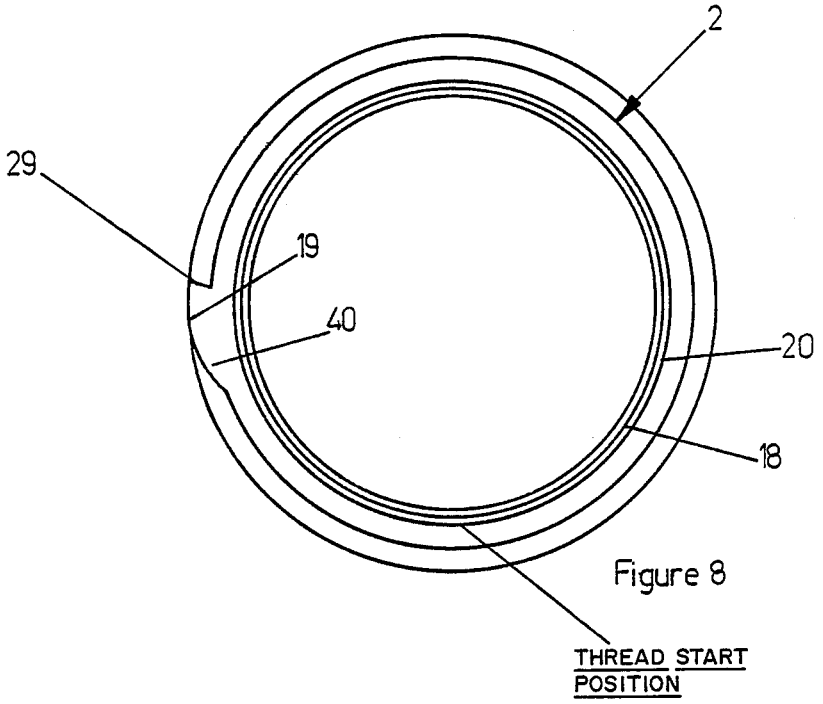
FIG. 8 is a top plan view of the neck of a bottle suitable for use with the seal of FIGS. 1 to 7C and FIGS. 8 and 9 respectively.
Figure 9:
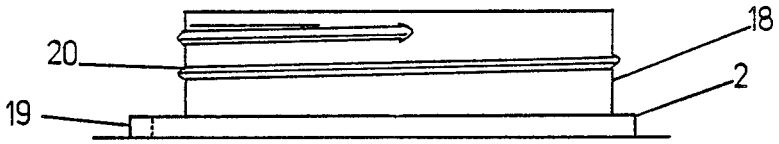
FIG. 9 is a side elevation of the neck of the bottle of FIG. 8.
Figure 10:
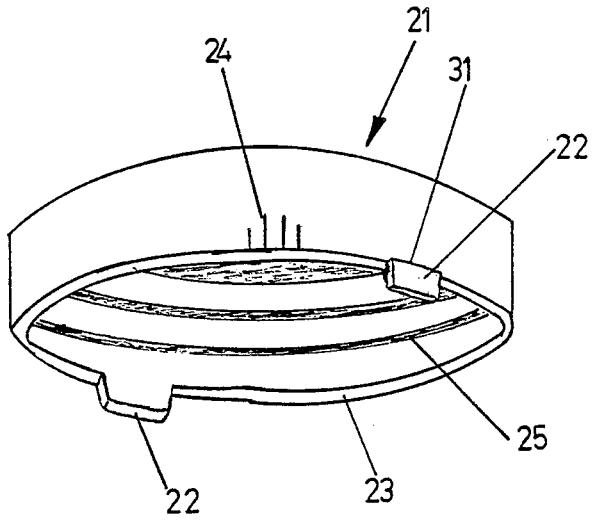
FIG. 10 is a perspective view of a cap suitable for use with the seal and the bottle neck of FIGS. 1 to 9.
Figure 16:
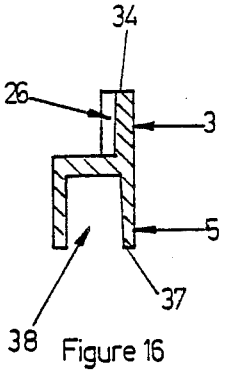
FIG. 16 is a section on an enlarged scale at U—U on the periphery of the seal ring as indicated in FIG. 11.
Figure 15:
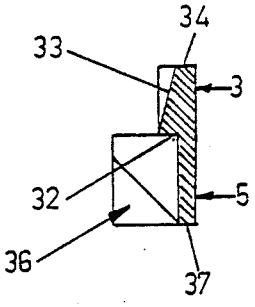
FIG. 15 is a section on an enlarged scale at V—V on the periphery of the seal ring as indicated in FIG. 11.
Figure 11:
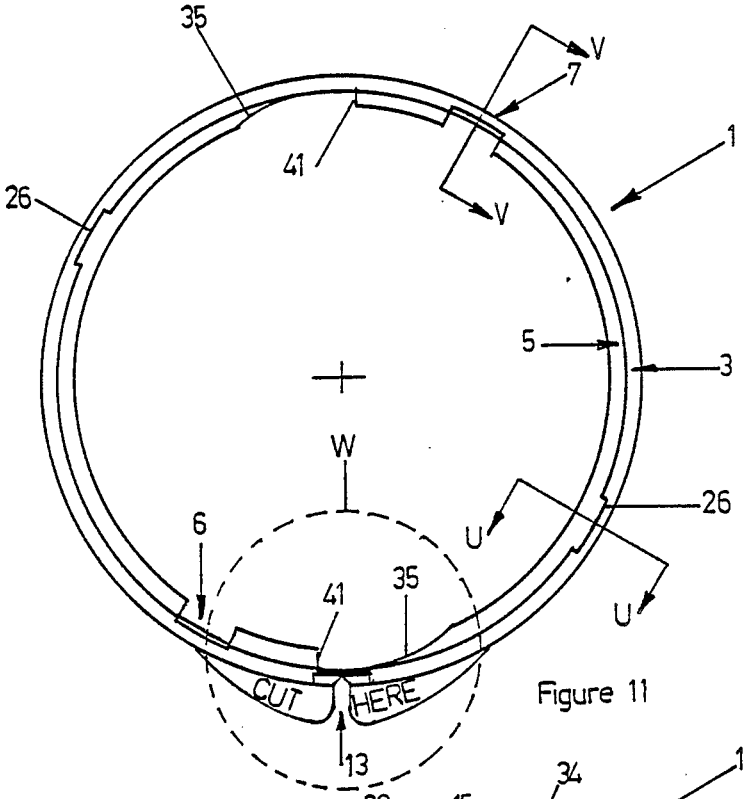
FIG. 11 is a top plan view of an alternative seal ring usable with the bottle neck and closure shown in FIGS. 8 to 10.
Figure 13:
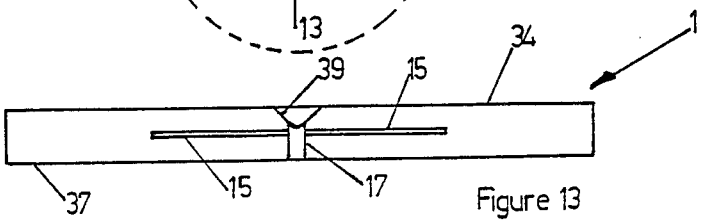
FIG. 13 is a side view of the seal ring shown in FIGS. 11 and 12.
Figure 12:
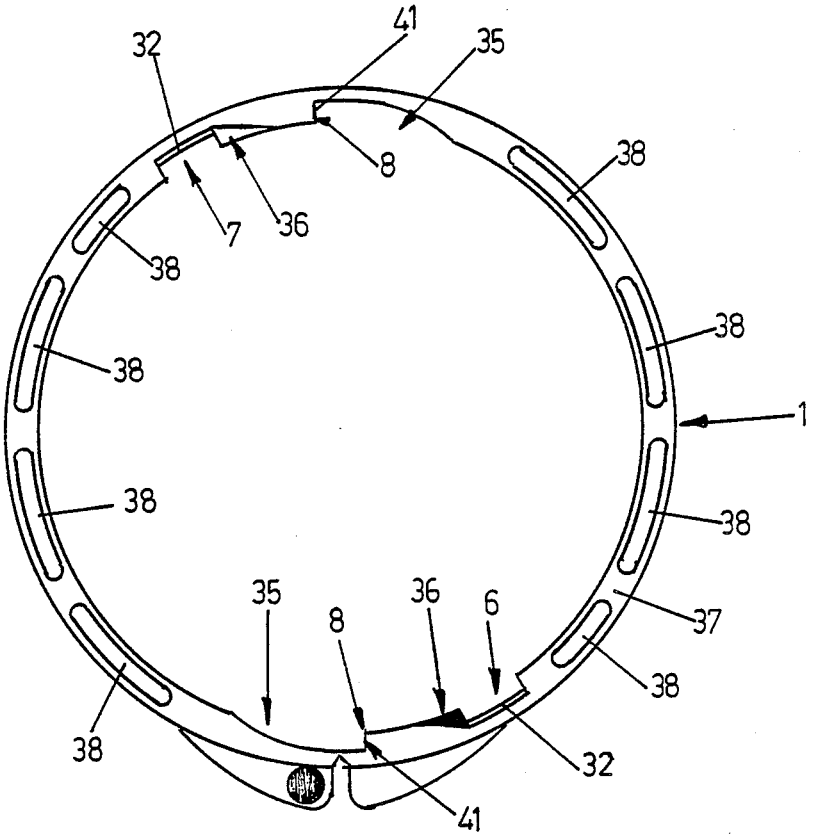
FIG. 12 is a view from below of the seal ring shown in FIG. 11.
Figure 14:
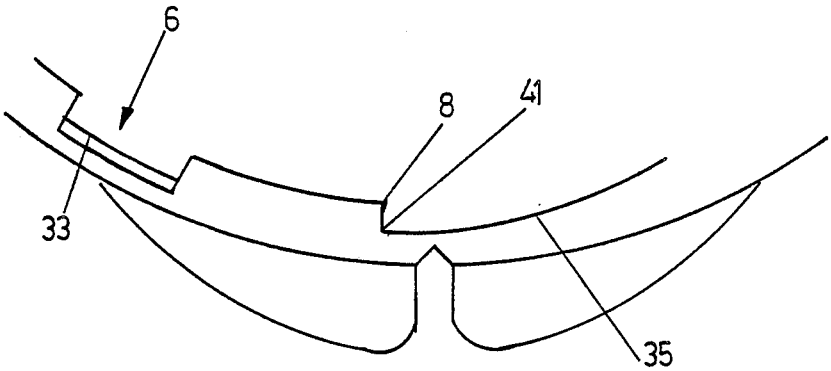
FIG. 14 is a plan view of the seal ring on an enlarged scale of the region W shown in FIG. 11.

In the first example shown in FIGS. 1 to 7C there is shown a seal 1 which, together with a bottle neck 2 of the type shown in FIGS. 8 and 9 and a cap of the type shown in FIG. 10 constitute a combination tamper proof seal for a container closure device. The seal 1 is made of a rigid plastic material and is comprised of three main sections, the top ring 3, the middle ring 4 and the base ring 5 as shown in FIG. 2.

Figure 3:
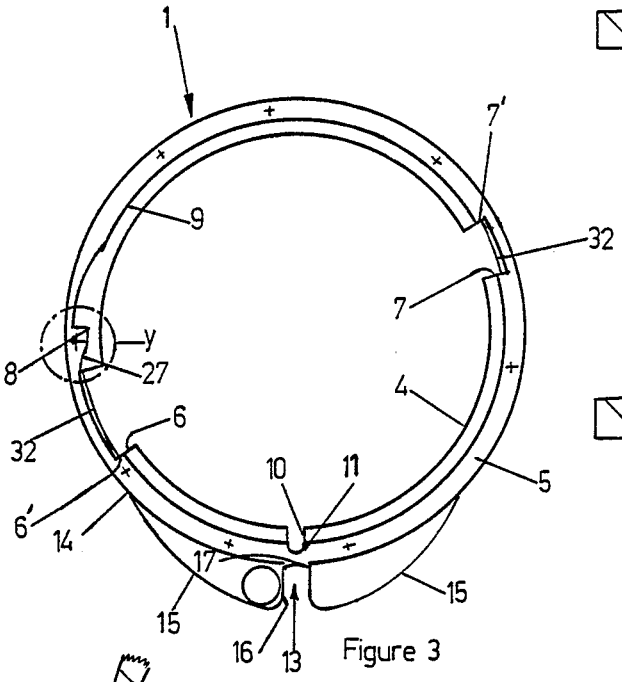
FIG. 3 is a view from below of the seal of FIGS. 1 and 2.
Figure 6:
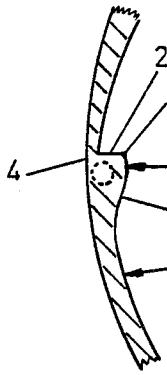
FIG. 6 is a plan view from below, on an enlarged scale, of the region Y referred to in FIG. 3.
Figure 7A:
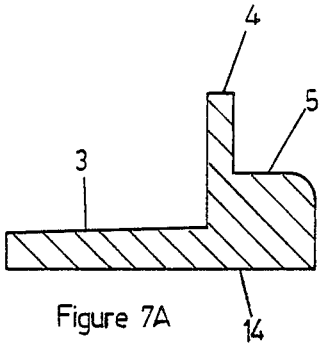
FIG. 7A is a section, on an enlarged scale, at point A—A on the periphery of the seal shown in FIG. 1.
Figure 7B:
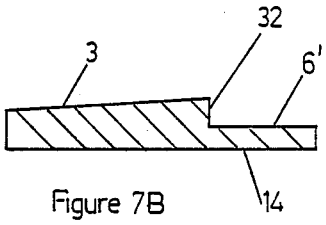
FIG. 7B is a section on an enlarged scale at point B—B on the periphery of the seal shown in FIG. 1.
Figure 7C:
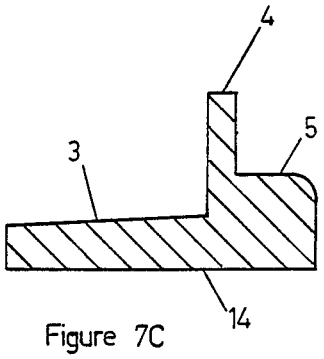
FIG. 7C is a section on an enlarged scale at point C—C on the periphery of the seal shown in FIG. 1.

The middle ring 4 is shown in FIGS. 1, 2 and 3. In the example the middle ring 4 has two recesses 6, 7 cut therein. The base ring 5 has cut into its inner periphery corresponding extensions 6', 7' to the recesses 6, 7 on the middle ring. The base ring 5 has a shaped stop 8 on its inner peripheral wall 9.

The middle ring 4 has a cut out 10 which with a reduced thickness portion 11 of the inner wall 9 of the base ring 5 forms a more easily cut region 13 for cutting the seal.

The seal 1 has extending outward from its outer wall 14 a pair of finger grips or indicating means 15 positioned on either side of a cut out 16. The outer wall 14 preferably has a V-shaped groove 17 which further reduces the thickness of the skirt wall of the seal.

The neck 18 of a bottle 2 for which the seal would be suitable, is shown in FIGS. 8 and 9. FIG. 8 shows a stop 19 formed in the bottle neck 18 which co-operates with the shaped stop 8 on the seal 1. FIGS. 8 and 9 also show a thread 20 on the bottle neck.

A closure 21 which could be used in this closure device is shown in FIG. 10 and is also preferably made of a rigid plastic material. It is provided with projections 22 on the lower edge 23 and finger grips 24 on either side of the closure 21. There is also a thread 25 provided on the inside of the closure 21.

The tamper proof seal and container closure device shown in FIGS. 1 to 10 of the present invention is operated as follows.

The seal 1 is placed in association with the closure 21 with the projections 22 within the slots 6, 7. The finger grips 24 fit within the slightly recessed regions 26 of the upper ring 3. The projections 22 preferably have a stepped region 31 which extends outward from the outer surface wall 14. The stepped region 31 co-operates with a step 32 (FIGS. 3 and 7B) to hold the closure 21 and ring 1 together for fitting or shipping. The combined closure and ring are then screwed onto the bottle neck until the shaped stop 8 locks over the complementary stop 19 on the bottle neck. The cam surface 27 of the stop 8 eases the edge 28 (FIG. 6) of the stop 8 over the corresponding surface of the stop 19 while the closure is screwed into place. The locking engagement between the face 29 of the stop 8 and face 30 of stop 19 prevents unscrewing of the closure.

Once the seal 1 is in place with the closure 21 on the neck 2 the contact between the faces 29 and 30 will prevent the closure from moving backward (i.e. unscrewing).

The closure 21 is then securely held onto the neck 2 by the seal 1 and can not be released without the aid of a knife.

The seal 1 is provided with the indicating means 15 which indicate that the seal 1 should be cut at this point in order to release the closure 21.

Once the seal 1 has been cut the seal can be removed. The closure 21 can then be removed. Preferably the shape and dimensions of the projections 22 are such that unscrewing is not possible until opposite sides of the closure 21 are squeezed, as indicated at the finger grips 24 on opposite sides of the closure 21. This deforms the closure 21 slightly to allow the bottom of the projection to ride over the stop 19 to allow the closure 21 to be unscrewed.

In the alternative example of seal ring shown in FIGS. 11 to 16 the same parts as those shown in the first example are referenced by similar numerals.

In this construction the seal ring 1 consists of a base ring 5 and upper ring 3 which are moulded from a plastic material. The base ring 5 has a pair of recesses 6, 7 each of which has a lug or step 32 formed by an angled region 33 which begins from the top edge 34 of the upper ring 3. The base ring 5 also has two stops 8 one on either side thereof. Each stop 8 has an arc shaped cutaway region 35 and adjacent thereto a chamfered region 36. The bottom edge 37 can have a plurality of grooves 38 which minimize material content in the seal 1.

The upper ring 3 has a pair of recessed regions 26 into which finger grips 24 fit when the seal 1 and closure 21 are fitted together.

The outside wall 14 of the seal ring 1 has a groove 17 cut therein to reduce the thickness of the wall where it is to be cut. The height of the wall at this cutting point is also reduced by the V-shaped cut out 39.

In use the closure 21 and seal ring 1 are clipped together by fitting the base 23 of the closure into the upper ring 3. The projections 22 slide in the slots 6, 7 until the latch 31 engages over the top 4 lug 32 in the slots 6, 7. The closure 21 is screwed onto a bottle neck 2 similar to that shown in FIGS. 8 and 9. The bottle neck 2 for this seal ring 1 and closure combination has a pair of stops 19 one on each side of the base of the bottle neck. The stops 19 are shaped to fit within the cutaway regions 35 of the seal ring 1. The provision of the chamfered region 36 aids the application of the combination to the bottle neck 2. As the cam region 40 contacts the chamfered region 36 the opposite edges of the ring 1 and closure 21 rise slightly until the stops 19 fit within their respective cutaway regions 35. When locked together the closure cannot be released because of the interaction between the surface 29 and the edge 41 of the stop 8. Only when the ring 1 is cut can the closure 21 be released. As the projections 22 still extend below the level of the top of the stop 19 the closure cannot be released until the finger grips 24 are squeezed to deform the closure 21 slightly and allow the bottom of the projections 22 to run over the top of the stops 19. This provides an additional child proof barrier even after the seal ring 1 has been removed.

The foregoing describes only embodiments of the present invention and modifications, obvious to those skilled in the art, can be made thereto without departing from the scope of the appended claims.

What we do claim and desire to obtain by Letters Patent of the United States is:

1. A tamper proof seal and container closure device including, in combination;

a seal ring and a closure, said seal ring being generally annular shaped and provided on an inner face thereof with at least one recess and at least one stop, said closure being provided with at least one projection on the lower edge of the closure, said projection being adapted to fit within the recess of the seal so that when the combination seal ring and closure are fitted to a bottle neck the stop on the seal ring locks the seal ring, closure and bottle neck together.

2. A tamper proof seal and closure device as claimed in claim 1 wherein the seal ring and closure are adapted to be locked onto the bottle neck by the interaction between the stop on the seal and a complementary stop formed on the side of the base of the bottle neck.

3. A tamper proof seal and closure device as claimed in claim 2 wherein each projection has a stepped region which extends out from the outside wall of the closure to form a latch which co-operates with a step on the edge of the recess to locate the closure and seal ring together.

4. A tamper proof seal and closure device as claimed in claim 2 wherein the seal ring is formed as an annular skirt with a base ring, middle ring and top ring.

5. A tamper proof seal and closure device as claimed in claim 4 wherein the base ring has an internal diameter designed to fit over the base of the bottle neck, the middle ring has an internal diameter similar to the internal diameter of the closure and the top ring has an internal diameter designed to engage with the skirt of the closure.

6. A tamper proof seal and closure device as claimed in claim 5 wherein the seal ring has a side wall thereof reduced in thickness and height at one point to produce a more easily cut region for assisting in removal of the seal ring.

7. A tamper proof seal and closure device as claimed in claim 6 wherein the closure has two projections which interfit with two recesses in the inner periphery of the seal ring and with a pair of stops formed on the side of the base of the bottle neck.

8. A tamper proof seal and closure device as claimed in claim 2 wherein the seal ring is formed as an annular skirt with a base ring and top ring.

9. A tamper proof seal and closure device as claimed in claim 8 wherein the top ring has an internal diameter designed to engage with the skirt of the closure.

10. A tamper proof seal and closure device as claimed in claim 9 wherein the seal ring has a side wall thereof reduced in thickness and height at one point to produce a more easily cut region for assisting in removal of the seal ring.

11. A tamper proof seal and closure device as claimed in claim 10 wherein the closure has two projections which interfit with two recesses in the inner periphery of the seal ring and with a pair of stops formed on the side of the base of the bottle neck.

12. A tamper proof seal and closure device as claimed in claim 2 wherein the combination is such that to release the closure the seal must be cut to allow the closure to pass over the stop at the base of the neck and rotate relative to the neck to thereby release the closure.

* * * * *